US010619795B2

(12) United States Patent
Lambert et al.

(10) Patent No.: US 10,619,795 B2
(45) Date of Patent: Apr. 14, 2020

(54) MONITORING APPARATUS FOR PRESSURE VESSELS

(71) Applicant: LINDE AKTIENGESELLSCHAFT, Munich (DE)

(72) Inventors: Piers Lambert, Surrey (GB); Rigoberto Perez De Alejo Fortun, Guildford (GB); Helmut Franz, Starnberg (GB)

(73) Assignee: LINDE AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/063,494

(22) PCT Filed: Dec. 8, 2016

(86) PCT No.: PCT/EP2016/080243
§ 371 (c)(1),
(2) Date: Jun. 18, 2018

(87) PCT Pub. No.: WO2017/102537
PCT Pub. Date: Jun. 22, 2017

(65) Prior Publication Data

US 2019/0003649 A1 Jan. 3, 2019

(30) Foreign Application Priority Data

Dec. 18, 2015 (GB) ..... 1522457.9

(51) Int. Cl.
*F17C 13/02* (2006.01)

(52) U.S. Cl.
CPC ..... *F17C 13/025* (2013.01); *F17C 2221/011* (2013.01); *F17C 2250/032* (2013.01);
(Continued)

(58) Field of Classification Search
CPC ..... F17C 13/025; F17C 2221/011; F17C 2250/0694; F17C 2250/072; F17C 2250/0439
See application file for complete search history.

(56) References Cited

U.S. PATENT DOCUMENTS 6,944,570 B2 * 9/2005 Neeser et al. ..... F17C 13/025 702/156
10,228,091 B2 * 3/2019 Carron et al. ..... F17C 13/025
(Continued)

OTHER PUBLICATIONS

International Search Report for PCT/EP2016/080243 dated Apr. 4, 2017.

*Primary Examiner* — Kevin L Lee
(74) *Attorney, Agent, or Firm* — Millen White Zelano & Branigan, PC

(57) ABSTRACT

The present invention provides a monitoring apparatus for an outlet of a vessel storing gas under pressure. The monitoring apparatus comprises a flow control valve movable to a position between a fully open position and a fully closed position to adjust a flow of gas from the outlet of the vessel, a valve position detector connected to the flow control valve to detect the position of the flow control valve, an internal pressure sensor to sense an internal pressure $P_{int}(t)$ of the gas in the vessel at different times, a processor, a memory and an alarm. The processor calculates an actual rate of change in pressure $dP_{int}/dt$ of the gas in the vessel over time, and compares $dP_{int}/dt$ with an expected rate of change.

43 Claims, 6 Drawing Sheets

(52) U.S. Cl.
CPC ..... *F17C 2250/0434* (2013.01); *F17C 2250/0439* (2013.01); *F17C 2250/0478* (2013.01); *F17C 2250/0694* (2013.01); *F17C 2250/072* (2013.01); *F17C 2270/025* (2013.01)

(56) References Cited

U.S. PATENT DOCUMENTS

2010/0305883 A1* 12/2010 Danzy ..... F16K 17/04
702/50
2015/0053274 A1 2/2015 Gordon

* cited by examiner

MONITORING APPARATUS FOR PRESSURE VESSELS

The present invention concerns a monitoring apparatus for an outlet of a vessel storing gas under pressure. The present invention is particularly suitable for application to vessels storing therapeutic gases under pressure, but is not limited to such applications.

It would be desirable to be able to monitor the flow of a gas from an outlet of a vessel storing gas under pressure, in order to determine if the flow of gas has been accidentally interrupted or is otherwise not being supplied as intended. For example, a member of the medical professional may administer a therapeutic gas, such as oxygen, to a patient from a pressurized gas vessel accompanying the patient. Typically, the gas is supplied to the patient via a gas supply tube from the outlet of the vessel to a respiratory interface for the patient, such as a respiratory mask, mouthpiece, nasal cannula, tracheal tube or other type of such interface. The flow of gas from the outlet of the vessel to the patient is usually controlled by adjusting a flow control valve movable to a position between a fully open position and a fully closed position, until a desired flow rate of gas to the patient has been achieved. However, the gas supply tube from the outlet of the vessel to the respiratory interface may become accidentally kinked, thereby cutting off the supply of gas to the patient, for example if the patient happens to lie on the gas supply tube during their sleep. Alternatively, the respiratory interface may become detached from the patient, for example again by accidental movement of the patient during their sleep, in which case, the gas will continue to be supplied from the vessel storing the gas under pressure, but will leak into the atmosphere rather than being received by the patient. In either case, therefore, the consequences for the patient are undesirable, since the patient will no longer be receiving a supply of the therapeutic gas as intended. There is therefore a need to be able to monitor the flow of gas from the outlet of the vessel storing the gas under pressure to allow corrective action to be taken in such cases. In other contexts where a gas is being supplied from an outlet of a vessel storing the gas under pressure, it can be seen that it would be equally desirable to be able to monitor the flow of gas from the outlet of the vessel so that corrective action can be taken if the gas supply is interrupted or is otherwise not being supplied as intended.

Several systems in the prior art describe ways of deriving the remaining time or the remaining quantity of gas contained in a vessel storing gas under pressure. For example, WO 2005/093377 describes a compact, integrated processing system for measuring the autonomy of a vessel storing gas under pressure, by which is meant the autonomy of the vessel in terms of remaining time or of the remaining quantity of gas in the vessel. This processing system comprises a compact module which includes an electronic pressure sensor for detecting a pressure of a gas contained in the vessel and computing means which use the pressure data measured by the electronic sensor in order to provide one or more pieces of information relating to the operating autonomy of the vessel.

WO 2012/164240, also in the name of the present applicant, describes a way of calculating the remaining time for a vessel storing gas under pressure using a system comprising a pressure sensor which senses a pressure of the gas on exit from the vessel, a flow control valve and a valve position detector connected to the flow control valve, which detects the position of the flow control valve. The system described therein further comprises a processor which uses the sensed pressure of the gas on exit from the vessel and the detected position of the flow control valve to calculate the remaining time for gas supply from the vessel. Since the flow control valve is manufactured to a high precision, the remaining time for gas supply from the vessel can be calculated more quickly and accurately than a system which relies just on sensing the pressure of the gas on exit from the vessel.

Accordingly, in a first aspect, the present invention provides a monitoring apparatus for an outlet of a vessel storing gas under pressure, comprising a flow control valve movable to a position between a fully open position and a fully closed position to adjust a flow of gas from the outlet of the vessel, a valve position detector connected to the flow control valve to detect the position of the flow control valve, an internal pressure sensor to sense an internal pressure $P_{int}(t)$ of the gas in the vessel at different times, a processor, a memory and an alarm.

The internal pressure sensor may be a sensor mounted within the vessel to sense the pressure $P_{int}(t)$ of the gas within the vessel or it may be mounted to the outlet of the vessel to sense the pressure $P_{int}(t)$ of the gas on exit from the vessel.

The processor is connected to the internal pressure sensor to receive from the internal pressure sensor the pressure $P_{int}(t)$ sensed thereby at different times and to calculate an actual rate of change in pressure $dP_{int}/dt$ of the gas in the vessel over time from the pressure $P_{int}(t)$ of the gas in the vessel sensed at different times.

Preferably, the memory is an internal memory of the processor, or it may be an external memory connected to the processor, or both. The memory stores a volume of the vessel and for that volume, an expected rate of change in pressure $(dP_{int}/dt)_{exp}$ of the gas in the vessel for each of a plurality of different positions of the flow control valve. Since the flow control valve is manufactured to a high precision, different positions of the flow control valve can be related to different expected rates of change in pressure $(dP_{int}/dt)_{exp}$, allowing the different expected rates of change in pressure $(dP_{int}/dt)_{exp}$ for a given volume of vessel and different rates of change in pressure to be stored in the memory for future retrieval.

The processor is connected to the valve position detector to receive from the valve position detector the position of the valve detected thereby and to retrieve from the memory the volume of the vessel and for that volume, the expected rate of change in pressure $(dP_{int}/dt)_{exp}$ of the gas in the vessel for the position of the valve detected by the valve position detector. The processor can then compare the actual rate of change in pressure $dP_{int}/dt$ with the expected rate of change in pressure $(dP_{int}/dt)_{exp}$ which has the same position of the valve as detected by the valve position detector and the same volume of the vessel as retrieved from the memory.

The alarm is connected to the processor to receive from the processor an alarm signal to activate the alarm if the actual rate of change in pressure $dP_{int}/dt$ is less than a first threshold $(dP_{int}/dt)_{min}$ defined in relation to the expected rate of change in pressure $(dP_{int}/dt)_{exp}$ which is compared with the actual rate of change in pressure $dP_{int}/dt$ and/or is more than a second threshold $(dP_{int}/dt)_{max}$ defined in relation to the expected rate of change in pressure $(dP_{int}/dt)_{exp}$ which is compared with the actual rate of change in pressure $dP_{int}/dt$.

Thus, for example, if a gas supply tube from the outlet of the vessel to a patient is accidentally kinked, the actual rate of change in pressure $dP_{int}/dt$ will be less than the first threshold $(dP_{int}/dt)_{min}$ and the alarm will be activated or if a respiratory interface becomes detached from the patient, the actual rate of change in pressure $dP_{int}/dt$ will be more than the second threshold $(dP_{int}/dt)_{max}$ and the alarm will be activated.

The memory may store a plurality of expected rates of change in pressure $(dP_{int}/dt)_{exp}$ for vessels of different volumes of the gas in each respective vessel for each of a plurality of different positions of the flow control valve, so that the monitoring apparatus can be used with a corresponding variety of differently sized vessels.

The monitoring apparatus may comprise a first user interface whereby a user may manually define at least one of the first and second thresholds $(dP_{int}/dt)_{min}$, $(dP_{int}/dt)_{max}$. Thus, for example, the first user interface may be a touch screen whereby a medical professional may enter a value for at least one of the first and second thresholds.

Alternatively or additionally, the processor may be able to calculate at least one of the first and second thresholds $(dP_{int}/dt)_{min}$, $(dP_{int}/dt)_{max}$ in dependence on the expected rate of change in pressure $(dP_{int}/dt)_{exp}$ which is compared with the actual rate of change in pressure $dP_{int}/dt$. For example, the processor may calculate the first threshold $(dP_{int}/dt)_{min}$ to be 25% less and/or the second threshold $(dP_{int}/dt)_{max}$ to be 25% more than the expected rate of change in pressure $(dP_{int}/dt)_{exp}$ which is compared with the actual rate of change in pressure $dP_{int}/dt$.

In such a case, the processor may calculate a range $(dP_{int}/dt)_{max}-(dP_{int}/dt)_{min}$ of acceptable rates of change in pressure between the first and second thresholds $(dP_{int}/dt)_{min}$, $(dP_{int}/dt)_{max}$ in proportion to the expected rate of change in pressure $(dP_{int}/dt)_{exp}$ which is compared with the actual rate of change in pressure $dP_{int}/dt$. Thus if the pressure of the gas in the vessel is expected to be changing rapidly, the range of acceptable flow rates may be wider than if the pressure of the gas in the vessel is expected to be changing only slowly.

The processor may also calculate a remaining time and/or a remaining quantity of gas contained in the vessel from the actual rate of change in pressure $dP_{int}/dt$, the detected position of the flow control valve and the volume of the vessel.

Alternatively or additionally, the processor may calculate an actual flow rate $dV/dt$ of gas from the vessel from the actual rate of change in pressure $dP_{int}/dt$, the detected position of the flow control valve and the volume of the vessel.

Preferably, the processor gives the alarm signal a first characteristic if the actual rate of change in pressure $dP_{int}/dt$ is less than the first threshold $(dP_{int}/dt)_{min}$ and a second characteristic different from the first characteristic if the actual rate of change in pressure $dP_{int}/dt$ is more than the second threshold $(dP_{int}/dt)_{max}$. Thus the alarm signal could be a different sound (short beeps, for example) if the actual rate of change in pressure is too low from the sound of the alarm signal (long beeps, for example) if the actual rate of change in pressure is too high.

Preferably, the monitoring apparatus comprises a second user interface whereby a user may manually disable the alarm. The second user interface may coincide with the first user interface and may therefore be a touch screen. Alternatively, it may be a simple push button, for example. Thus, a medical professional may disable the alarm if they determine by inspection that the supply of a gas to a patient is acceptable in spite of the alarm being activated.

The monitoring apparatus may further comprise an internal temperature sensor to sense a temperature $T_{int}(t)$ of the gas in the vessel at different times, and in such a case, the processor may be connected to the internal temperature sensor to receive from it the temperature $T_{int}(t)$ sensed thereby at different times and to calculate at least one of a rate of change in temperature $dT_{int}/dt$ of the gas in the vessel over time and the second derivative $d_2T_{int}/dt^2$ with respect to time of the temperature of the gas in the vessel from the temperature $T_{int}(t)$ of the gas in the vessel sensed at different times. If so, the processor can either adjust a value of at least one of the first and second thresholds $(dP_{int}/dt)_{min}$, $(dP_{int}/dt)_{max}$ or disable the alarm on the basis of at least one of the rate of change in temperature $dT_{int}/dt$ of the gas in the vessel over time and the second derivative $d_2T_{int}/dt^2$ with respect to time of the temperature of the gas in the vessel. Thus, for example, if the vessel is transferred from a cold to a warm environment, such as if the vessel is moved from outdoors into a warm hospital, or vice versa, a change in temperature of the gas in the vessel as it equilibrates with the vessel's new environment will be detected by the internal temperature sensor and the processor can compensate for the effects of this change in temperature on the actual rate of change in pressure of the gas in the vessel either by adjusting a value of at least one of the first and second thresholds or by disabling the alarm. This can be used to avoid false alarms in such situations.

The internal temperature sensor may be a sensor mounted within the vessel to sense the temperature $T_{int}(t)$ of the gas within the vessel or it may be mounted to the outlet of the vessel to sense the temperature $T_{int}(t)$ of the gas on exit from the vessel.

Preferably, the monitoring apparatus further comprises an external temperature sensor to measure a temperature $T_{ext}$ of an external environment of the vessel, and the processor is connected to the external temperature sensor to receive from the external temperature sensor the temperature $T_{ext}$ of the environment measured thereby. In such a case, the processor may either adjust a value of at least one of the first and second thresholds $(dP_{int}/dt)_{min}$, $(dP_{int}/dt)_{max}$ or disable the alarm on the basis of the measured temperature $T_{ext}$ of the environment or the first derivative $dT_{ext}/dt$ or second derivative $d_2T_{ext}/dt^2$ with respect to time of the measured temperature $T_{ext}$ of the environment. Such additional features of the monitoring apparatus may also be used to compensate for the effects of a change in temperature on the actual rate of change in pressure of the gas in the vessel and to avoid false alarms in such situations.

Alternatively or additionally, the monitoring apparatus preferably also comprises an external pressure sensor to sense a pressure $P_{ext}$ of the external environment of the vessel, and the processor is connected to the external pressure sensor to receive from the external pressure sensor the pressure $P_{ext}$ of the environment sensed thereby. In such a case, the processor may either adjust a value of at least one of the first and second thresholds $(dP_{int}/dt)_{min}$, $(dP_{int}/dt)_{max}$ or disable the alarm on the basis of the sensed pressure $P_{ext}$ of the environment or the first derivative $dP_{ext}/dt$ or second derivative $d_2P_{ext}/dt^2$ with respect to time of the sensed pressure $P_{ext}$ of the environment. Thus, if the pressure of the external environment of the vessel changed significantly, for example if the vessel were used at altitude, the actual rate of change in pressure of the gas in the vessel would also change. Such additional features of the monitoring apparatus may be used to correct for this, as well as to prevent a false alarm if the pressure of the external environment changes rapidly, for example if the vessel were on board a plane at take-off or landing.

Preferably, the processor is arranged to poll the internal pressure sensor at a given frequency. Preferably, the processor is also arranged to poll at least one of the valve position detector, the internal temperature sensor, the external temperature sensor and the external pressure sensor at the same given frequency. The given frequency may be between 2 and 0.05 times per second.

Alternatively or additionally, the processor may be arranged to log in the memory the internal pressure $P_{int}(t)$ of the gas in the vessel sensed at different times. Preferably, the processor is also arranged to log in the memory at least one of the detected position of the flow control valve, the temperature $T_{int}(t)$ of the gas in the vessel measured at different times, the measured temperature $T_{ext}$ of the external environment of the vessel and the sensed pressure $P_{ext}$ of the external environment of the vessel.

If so, the rate of change in pressure $dP_{int}/dt$ of the gas in the vessel over time may be calculated using a moving average over a given period of time of the logged pressure $P_{int}(t)$ of the gas in the vessel sensed at different times, and the rate of change in temperature $dT_{int}/dt$ of the gas in the vessel over time may also be calculated using a moving average over the same given period of time of the logged temperature $T_{int}(t)$ of the gas in the vessel measured at different times.

The given period of time may be defined in relation to the expected rate of change in pressure $(dP_{int}/dt)_{exp}$ which is compared with the actual rate of change in pressure $dP_{int}/dt$. For example, it may be between 20 seconds and 10 minutes if the flow control valve is detected to be in an open position and between 10 minutes and 4 hours if the flow control valve is detected to be in the fully closed position.

Preferably, the monitoring apparatus further comprises a display for visually displaying an alarm condition if the actual rate of change in pressure $dP_{int}/dt$ is less than the first threshold $(dP_{int}/dt)_{min}$ and/or more than the second threshold $(dP_{int}/dt)_{max}$.

In a preferred embodiment, the flow control valve, the valve position detector, the internal pressure sensor, the processor, the memory, the alarm, the first user interface, the second user interface, the internal temperature sensor, the external temperature sensor, the external pressure sensor and the display may all be integrated into a unit mountable to the outlet of the vessel.

In a second aspect, the present invention also provides a vessel storing gas under pressure with an outlet having a monitoring apparatus according to the first aspect of the invention mounted thereto. In such a case, the monitoring apparatus may have any of the further optional features described above.

If a gas stored in the vessel under pressure is a therapeutic gas, the therapeutic gas may be any combination of medical air, oxygen, helium, heliox (i.e. a helium/oxygen mixture), argon, xenon, nitrous oxide, a nitrous oxide/oxygen mixture, nitric oxide, carbon monoxide, carbogen (i.e. a carbon dioxide/oxygen mixture), $SF_6$ and $H_2S$, but is not limited to the aforementioned gases.

In a third aspect, the present invention provides a method of monitoring flow of a gas from an outlet of a vessel storing gas under pressure, comprising the following steps. Controlling the flow of gas from the outlet of the vessel with a flow control valve movable to a position x between a fully open position and a fully closed position, detecting the position x of the flow control valve, sensing a pressure $P_{int}(t)$ of the gas in the vessel at different times, calculating an actual rate of change in pressure $dP_{int}/dt$ of the gas in the vessel over time from the pressure of the gas $P_{int}(t)$ in the vessel sensed at different times, storing a volume V of the vessel and for that volume, an expected rate of change in pressure $(dP_{int}/dt)_{exp}$ of the gas in the vessel for each of a plurality of different positions of the flow control valve, comparing the actual rate of change in pressure $dP_{int}/dt$ with the expected rate of change in pressure $(dP_{int}/dt)_{exp}$ for the same position x of the valve as detected and the same volume V of the vessel as stored, defining a first threshold $(dP_{int}/dt)_{min}$ in relation to the expected rate of change in pressure $(dP_{int}/dt)_{exp}$ which is compared with actual rate of change in pressure $dP_{int}/dt$, and generating an alarm signal if the actual rate of change in pressure $dP_{int}/dt$ is less than the first threshold $(dP_{int}/dt)_{min}$.

The method preferably also comprises defining a second threshold $(dP_{int}/dt)_{max}$ in relation to the expected rate of change in pressure $(dP_{int}/dt)_{exp}$ which is compared with actual rate of change in pressure $dP_{int}/dt$, and generating the alarm signal if the actual rate of change in pressure $dP_{int}/dt$ is more than the second threshold $(dP_{int}/dt)_{max}$.

The method of monitoring flow of a gas from an outlet of a vessel storing gas under pressure according to the third aspect of the invention may have any of the further optional features of the first aspect of the invention described above.

BRIEF DESCRIPTION OF THE DRAWINGS

Further features and advantages of the present invention will become apparent from the following detailed description, which is given by way of example and in association with the accompanying drawings, in which.

Figure 1:
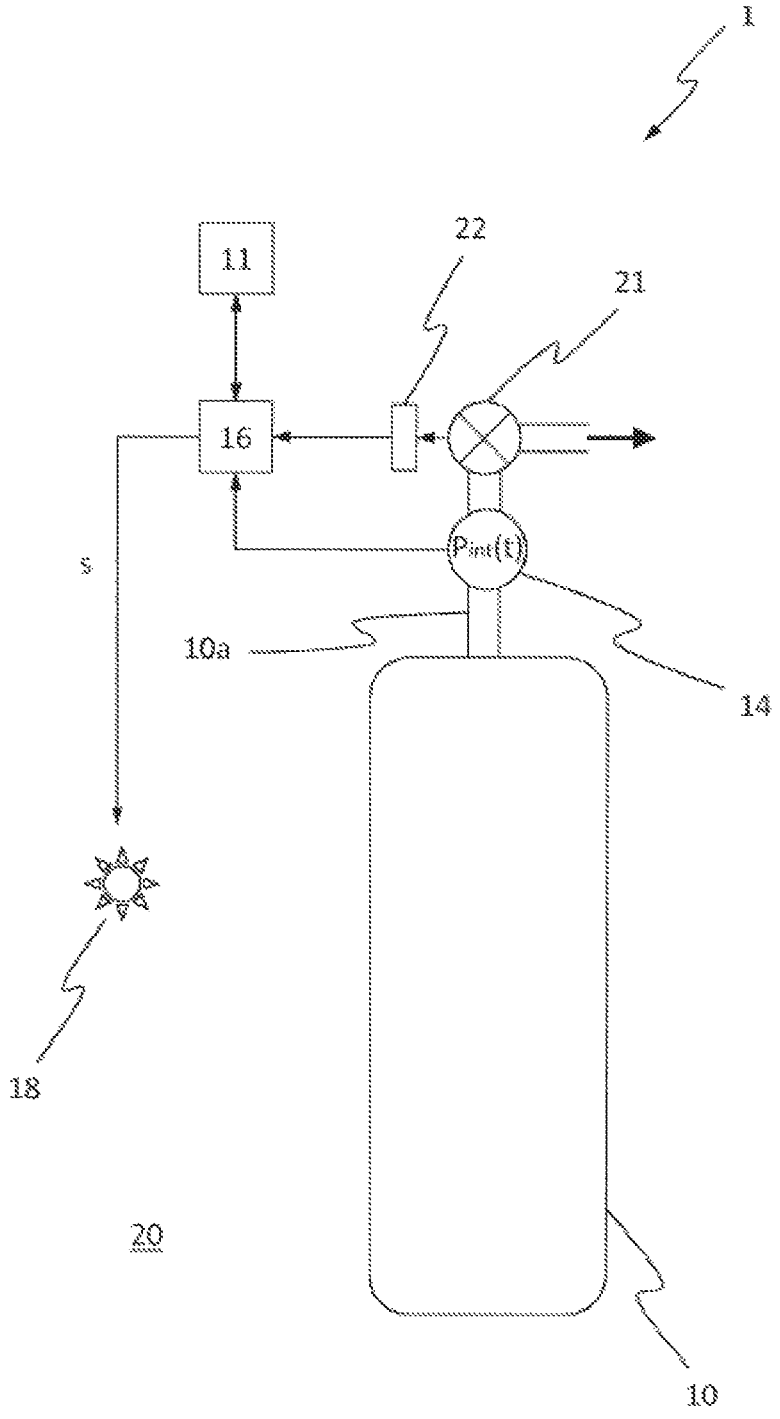
FIG. 1 is a schematic diagram of a first embodiment of a monitoring apparatus according to the invention shown on an outlet of a vessel storing gas under pressure.

Referring firstly to FIG. 1, there is schematically shown a first embodiment 1 of a monitoring apparatus according to the invention on an outlet 10*a* of a vessel 10 storing gas under pressure. The monitoring apparatus 1 comprises an internal pressure sensor 14, a flow control valve 21, a valve position detector 22, a processor 16, a memory 11 and an alarm 18. The internal pressure sensor 14 senses an internal pressure $P_{int}(t)$ of the gas in the vessel 10 at different times. In this embodiment, the internal pressure sensor 14 senses the pressure of the gas in the vessel 10 on exit of the gas from the vessel through outlet 10*a*. However, in alternative embodiments, the internal pressure sensor 14 could instead be contained within the vessel 10 and sense the pressure of the gas in the vessel directly. The flow control valve 21 is movable to a position between a fully open position and a fully closed position to adjust a flow of gas from the outlet 10*a* of the vessel 10, and the valve position detector 22 is connected to the flow control valve 21 to detect the position of the flow control valve. Both the internal pressure sensor 14 and the valve position detector 22 are connected to the processor 16 so that the processor 16 can receive from the internal pressure sensor 14 the pressure $P_{int}(t)$ of the gas in the vessel 10 sensed thereby at different times and can also receive from the valve position detector 22 the position of the valve 21 detected thereby. The alarm 18 is connected to the processor 16 so that the alarm 18 can receive from the processor 16 an alarm signal s.

In this embodiment, the memory 11 is an internal component of the processor 16. However, in alternative embodiments, the memory 11 could instead be connected to the processor 16 as an external component. Furthermore, the processor 16 could comprise an internal memory 11 in addition to being connected to an external memory. In any event, the memory 11 stores a volume of the vessel 10 and for that volume, an expected rate of change in pressure $(dP_{int}/dt)_{exp}$ of the gas in the vessel 10 for each of a plurality of different positions of the flow control valve 21. Since the flow control valve 21 is manufactured with high precision, a different expected rate of change in pressure $(dP_{int}/dt)_{exp}$ can be related to each different position of the flow control valve 21 for a particular volume of the vessel.

In order that the monitoring apparatus 1 may be used with a variety of vessels of different volumes, the memory 11 may store a plurality of expected rates of change in pressure $(dP_{int}/dt)_{exp}$ for each of a plurality of different positions of the flow control valve 21, each of the plurality of expected rates of change in pressure $(dP_{int}/dt)_{exp}$ being for a different volume of vessel.

During operation, the processor 16 polls the internal pressure sensor 14 at a given frequency of between 2 and 0.05 times per second and logs in the memory 11 the internal pressure $P_{int}(t)$ of the gas in the vessel 10 sensed by the internal pressure sensor 14 at different times. The processor 16 then calculates an actual rate of change in pressure $dP_{int}/dt$ of the gas in the vessel 10 over time from the pressure $P_{int}(t)$ of the gas in the vessel 10 sensed by the internal pressure sensor 14 at different times. The processor 16 calculates the actual rate of change in pressure $dP_{int}/dt$ of the gas in the vessel 10 using a moving average over a given period of time of the logged internal pressure $P_{int}(t)$ of the gas in the vessel 10 sensed at different times. In this embodiment, the given period of time is 2 minutes.

The processor 16 also polls the valve position detector 22 at the same given frequency and logs the position of the valve 21 detected thereby in the memory 11. It then compares the actual rate of change in pressure $dP_{int}/dt$ with the expected rate of change in pressure $(dP_{int}/dt)_{exp}$ for the position of the valve 21 detected by the valve position detector 22 and for the volume of the vessel 10 stored in the memory 11. If the processor 16 finds that the actual rate of change in pressure $dP_{int}/dt$ is less than a first threshold $(dP/dt)_{min}$ defined in relation to the expected rate of change in pressure $(dP_{int}/dt)_{exp}$ which is compared with the actual rate of change in pressure $dP_{int}/dt$ and/or is more than a second threshold $(dP/dt)_{max}$ also defined in relation to the expected rate of change in pressure $(dP_{int}/dt)_{exp}$ which is compared with the actual rate of change in pressure $dP_{int}/dt$, then the processor issues an alarm signal s to the alarm 18 to activate the alarm.

Figure 2:
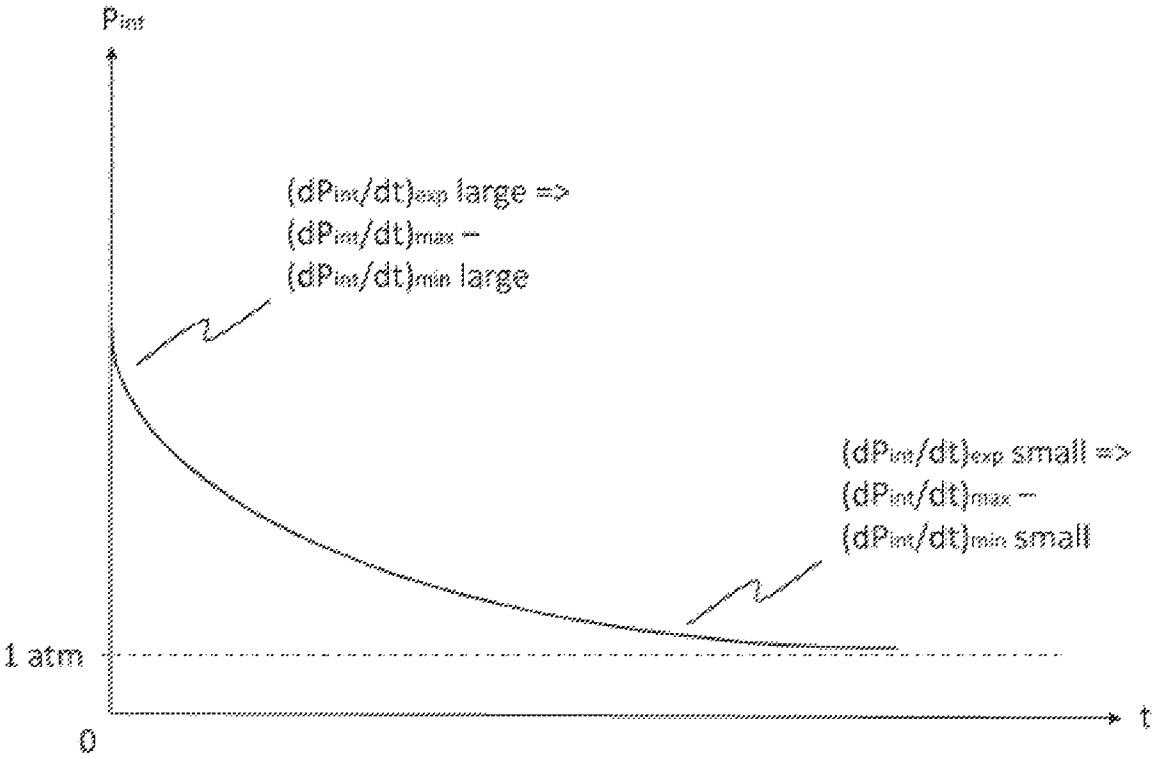
FIG. 2 is a graph showing how the pressure of a gas in a vessel storing the gas under pressure and the expected rate of change in pressure of the gas vary over time as the gas is consumed.

Either or both of the first and second thresholds $(dP_{int}/dt)_{min}$ and $(dP_{int}/dt)_{max}$ may be manually defined in relation to the expected rate of change in pressure $(dP_{int}/dt)_{exp}$ by a user of the monitoring apparatus 1, such as a clinician. For example, the user may set the first and second thresholds $(dP_{int}/dt)_{min}$ and $(dP_{int}/dt)_{max}$ to be 25% above and below the expected rate of change in pressure $(dP_{int}/dt)_{exp}$. For this purpose, the monitoring apparatus 1 may be provided with a first user interface 23, such as a touch screen, as shown in and described below in relation to FIG. 4. Alternatively or additionally, the processor 16 may be able to calculate at least one of the first and second thresholds $(dP_{int}/dt)_{min}$, $(dP_{int}/dt)_{max}$ in dependence on the expected rate of change in pressure $(dP_{int}/dt)_{exp}$ which is compared to the actual rate of change in pressure $dP_{int}/dt$. For example, the processor 16 could also set the first and second thresholds $(dP_{int}/dt)_{min}$ and $(dP_{int}/dt)_{max}$ to be 25% above and below the expected rate of change in pressure $(dP_{int}/dt)_{exp}$. If so, the processor 16 could calculate a range $(dP_{int}/dt)_{max}-(dP_{int}/dt)_{min}$ of acceptable rates of change in pressure between the first and second thresholds $(dP_{int}/dt)_{min}$, $(dP_{int}/dt)_{max}$ to be proportional to the expected rate of change in pressure $(dP_{int}/dt)_{exp}$ which is compared with the actual rate of change in pressure $dP_{int}/dt$. Thus, if the expected rate of change in pressure $(dP_{int}/dt)_{exp}$ is large, the processor would set the range $(dP_{int}/dt)_{max}$ $(dP_{int}/dt)_{min}$ of acceptable rates of change in pressure to be proportionally large, whereas if the expected rate of change in pressure $(dP_{int}/dt)_{exp}$ is small, the processor would set the range $(dP_{int}/dt)_{max}$ $(dP_{int}/dt)_{min}$ of acceptable rates of change in pressure to be proportionally small. This is shown in FIG. 2, which is a graph showing how the internal pressure $P_{int}$ of the gas in the vessel 10 changes over time t as the gas is used up. On the left-hand side of the graph, as the vessel 10 starts to discharge, the expected rate of change in pressure $(dP_{int}/dt)_{exp}$ is quite large, so the processor can set the range $(dP_{int}/dt)_{max}-(dP_{int}/dt)_{min}$ of acceptable rates of change in pressure to be proportionally large. On the right-hand side of the graph, as the vessel 10 is nearly fully discharged, so that the internal pressure $P_{int}$ of the gas in the vessel is approaching atmospheric pressure, the processor can set the range $(dP_{int}/dt)_{max}-(dP_{int}/dt)_{min}$ of acceptable rates of change in pressure to be correspondingly less.

The processor 16 gives the alarm signal s a first characteristic if the actual rate of change in pressure $dP_{int}/dt$ is less than the first threshold $(dP_{int}/dt)_{min}$ and a second characteristic different from the first characteristic if the actual rate of change in pressure $dP_{int}/dt$ is more than the second threshold $(dP_{int}/dt)_{max}$. For example, the first characteristic may be a series of short beeps and the second characteristic may be a series of longer beeps. Thus the alarm signal has a different sound if the actual rate of change in pressure $dP_{int}/dt$ is too low from if the actual rate of change in pressure $dP_{int}/dt$ is too high.

A user of the monitoring apparatus 1, such as a clinician, may be able to manually disable the alarm 18. For this purpose, the monitoring apparatus 1 may be provided with a second user interface 24, such as a push button, as shown in and described below in relation to FIG. 4, and/or the first user interface 23 may be provided with additional functionality to allow the user to do so.

Figure 3:
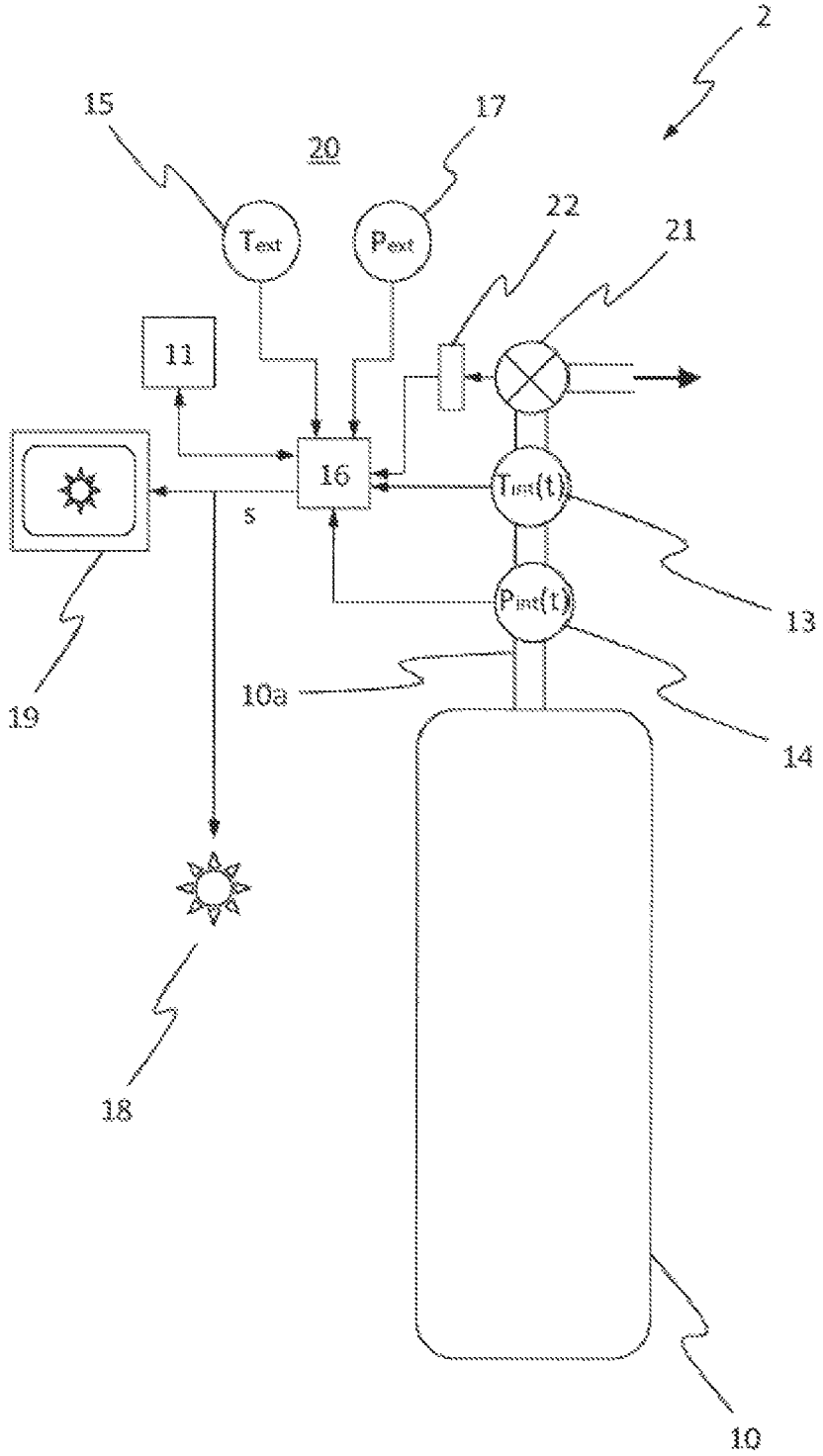
FIG. 3 is a schematic diagram of a second embodiment of a monitoring apparatus according to the invention shown on an outlet of a vessel storing gas under pressure.

Turning next to FIG. 3, there is schematically shown a second embodiment 2 of a monitoring apparatus according to the invention on an outlet 10*a* of a vessel 10 storing gas under pressure. In addition to the components of the monitoring apparatus 1 shown in FIG. 1 and described above, the monitoring apparatus 2 further comprises an internal temperature sensor 13, an external temperature sensor 15, an external pressure sensor 17 and a display 19. The internal temperature sensor 13 senses a temperature $T_{int}(t)$ of the gas in the vessel 10 at different times. In this embodiment, the internal temperature sensor 13 senses the temperature of the gas in the vessel 10 on exit of the gas from the vessel through outlet 10*a*. However, in alternative embodiments, the temperature sensor 13 could instead be contained within the vessel 10 and sense the temperature of the gas in the vessel directly. The external temperature sensor 15 measures a temperature $T_{ext}$ of an external environment 20 of the vessel 10 and the external pressure sensor 17 senses a pressure $P_{ext}$ of the external environment 20. The internal temperature sensor 13, the external temperature sensor 15 and the external pressure sensor 17 are all connected to the processor 16 so that the processor 16 can receive from the internal temperature sensor 13 the temperature $T_{int}(t)$ of the gas in the vessel 10 sensed thereby at different times, and can also receive from the external temperature sensor 15 and the external pressure sensor 17 the temperature $T_{ext}$ and the pressure $P_{ext}$ of the external environment 20, respectively, sensed thereby. The display 19 is also connected to the processor 16 so that the display 19 can visually display an alarm condition if the actual rate of change in pressure $dP_{int}/dt$ is less than the first threshold $(dP_{int}/dt)_{min}$ and/or more than the second threshold $(dP_{int}/dt)_{max}$.

During operation, monitoring apparatus 2 carries out all the same functions in the same way as monitoring apparatus 1 described above. Additionally, however, the processor 16 of monitoring apparatus 2 polls at least one of the internal temperature sensor 13, the external temperature sensor 15 and the external pressure sensor 17 at a given frequency of between 2 and 0.05 times per second and correspondingly logs in the memory 11 at least one of the temperature $T_{int}(t)$ of the gas in the vessel 10 measured by the internal temperature sensor 13 at different times, the measured temperature $T_{ext}$ of the external environment 20 of the vessel 10 and the sensed pressure $P_{ext}$ of the external environment 20. Depending on what information the processor 16 has logged in the memory 11, the processor 16 then calculates one or more of the following quantities. A rate of change in temperature $dT_{int}/dt$ of the gas in the vessel 10 over time from the temperature $T_{int}(t)$ of the gas in the vessel 10 sensed by the internal temperature sensor 13 at different times, the second derivative $d_2T_{int}/dt^2$ with respect to time of the temperature of the gas in the vessel 10, the first derivative $dT_{ext}/dt$ or second derivative $d_2T_{ext}/dt^2$ with respect to time of the measured temperature $T_{ext}$ of the environment 20, and the first derivative $dP_{ext}/dt$ or second derivative $d_2P_{ext}/dt^2$ with respect to time of the sensed pressure $P_{ext}$ of the environment 20. The processor 16 then either adjusts a value of at least one of the first and second thresholds $(dP_{int}/dt)_{min}$ and $(dP_{int}/dt)_{max}$ or disables the alarm 18 on the basis of one or more of these quantities. In this way, if the vessel encounters unusual operating conditions, for example, if the vessel is transferred from a cold to a warm environment, or is transferred from low to high altitude, or vice versa, the processor can compensate for changes in the actual rate of change in pressure of the gas in the vessel induced by the unusual operating conditions, in order to avoid a false alarm from being generated by the unusual operating conditions.

If the processor 16 calculates a rate of change in temperature $dT_{int}/dt$ of the gas in the vessel 10 over time from the temperature $T_{int}(t)$ of the gas in the vessel 10 sensed by the internal temperature sensor 13 at different times, it performs this calculation using a moving average of the logged temperature $T_{int}(t)$ of the gas in the vessel 10 measured at different times over the same given period as the processor 16 uses to calculate the actual rate of change in pressure $dP_{int}/dt$ of the gas in the vessel 10. The given period of time can be defined in relation to the expected rate of change in pressure $(dP_{int}/dt)_{exp}$ which is compared with the actual rate of change in pressure $dP_{int}/dt$. So, for example, the given period of time can be between 20 seconds and 10 minutes if the flow control valve 21 is detected to be in an open position, so that the expected rate of change in pressure $(dP_{int}/dt)_{exp}$ will be significantly more than if the flow control valve 21 is detected to be in the fully closed position, in which case, the given period of time can be between 10 minutes and 4 hours, since the expected rate of change in pressure $(dP_{int}/dt)_{exp}$ is then zero.

Figure 4:
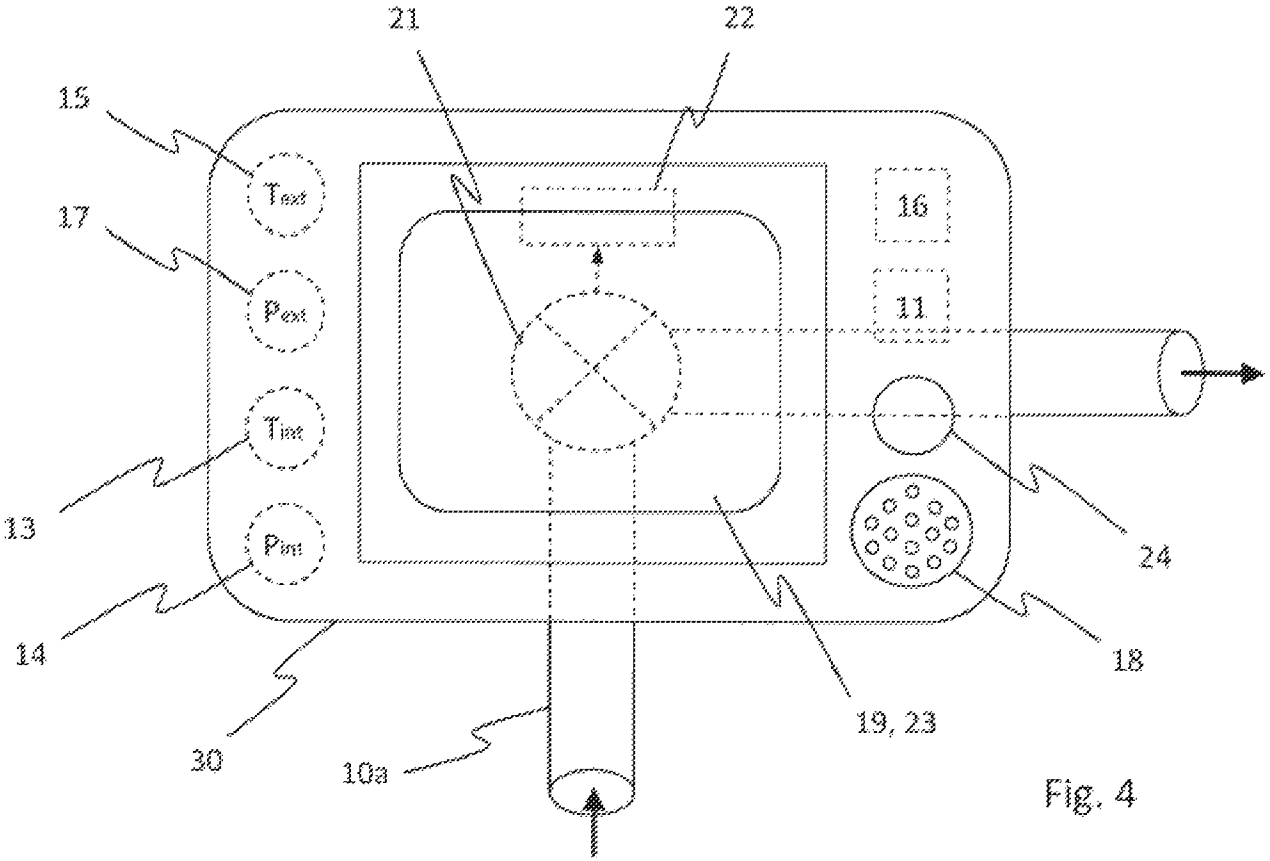
FIG. 4 is a schematic diagram of an exemplary embodiment of an integrated unit containing a monitoring apparatus according to the invention mounted to the outlet of a vessel storing gas under pressure.

Turning now to FIG. 4, there is schematically shown an exemplary embodiment of an integrated unit 30 containing a monitoring apparatus according to the invention mounted to the outlet 10*a* of a vessel 10 storing gas under pressure. The unit 30 contains the flow control valve 21, the valve position detector 22, the internal pressure sensor 14, the processor 16, the memory 11, the alarm 18, the first user interface 23, the second user interface 24, the internal temperature sensor 13, the external temperature sensor 15, the external pressure sensor 17 and the display 19, which are connected to each other and function as described above. In this exemplary embodiment, the first user interface 23 is a touch screen and the second user interface 24 is a push button. The touch screen also functions as a display 19 for visually displaying an alarm condition if the actual rate of change in pressure $dP_{int}/dt$ is less than the first threshold $(dP_{int}/dt)_{min}$ and/or more than the second threshold $(dP_{int}/dt)_{max}$.

Figure 5:
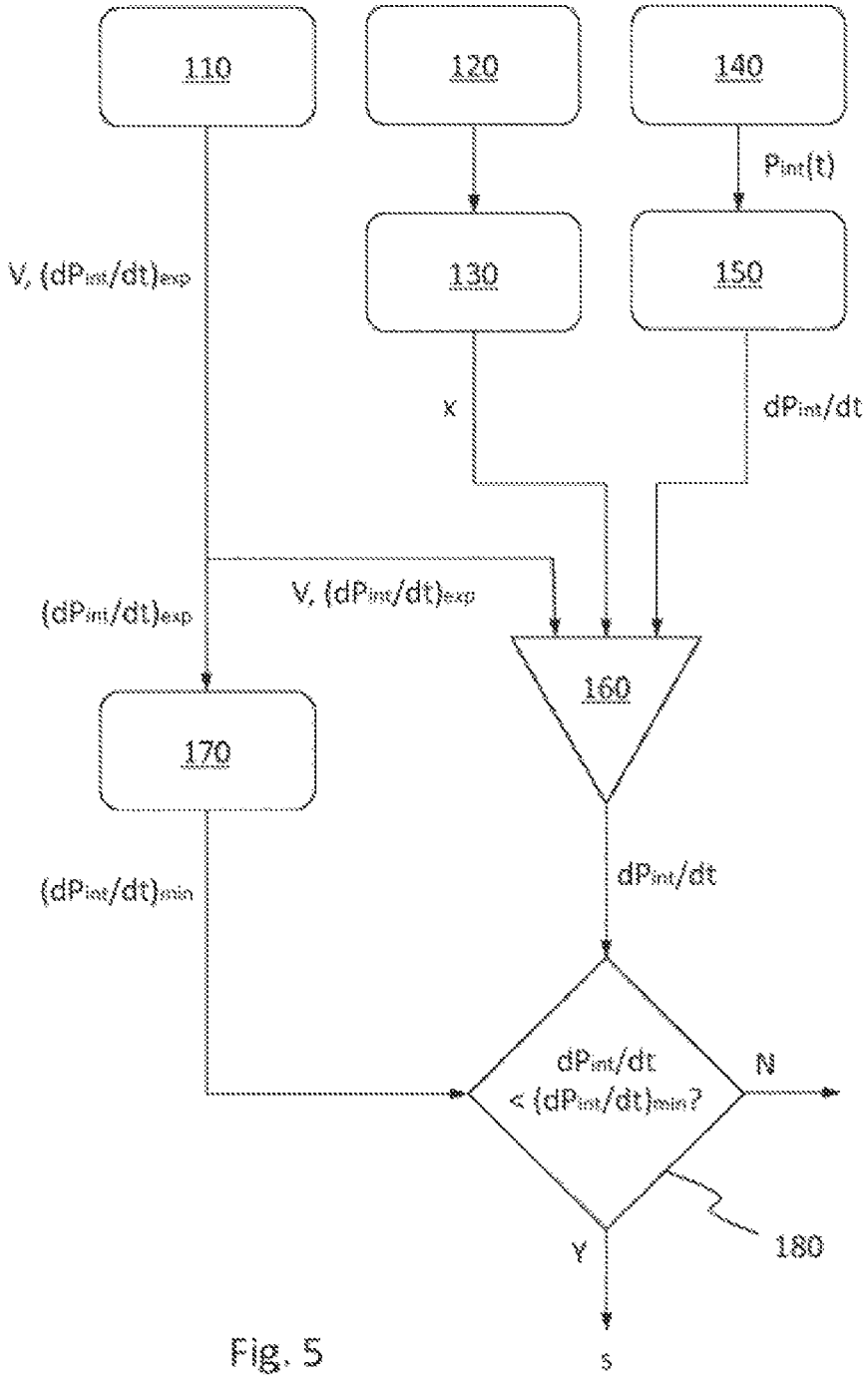
FIG. 5 is a flow diagram of a first embodiment of a method according to the invention of monitoring flow of a gas from an outlet of a vessel storing gas under pressure.

FIG. 5 is a flow diagram of a first embodiment of a method of monitoring flow of a gas from an outlet of a vessel storing gas under pressure. In step 110, a volume V of the vessel and for that volume, an expected rate of change in pressure $(dP_{int}/dt)_{exp}$ of the gas in the vessel for each of a plurality of different positions of the flow control valve are initially stored. In step 120, the flow of gas from the outlet of the vessel is controlled with a flow control valve movable to a position x between a fully open position and a fully closed position and in step 130, the position x of the flow control valve is detected. In step 140, an internal pressure $P_{int}(t)$ of the gas in the vessel is sensed at different times. In step 150, an actual rate of change in pressure $dP_{int}/dt$ of the gas in the vessel over time is calculated from the pressure of the gas $P_{int}(t)$ in the vessel sensed at different times. In step 160, the actual rate of change in pressure $dP_{int}/dt$ of the gas in the vessel is then compared with the expected rate of change in pressure $(dP_{int}/dt)_{exp}$ for the same position x of the valve as was detected in step 130 and the same volume V of the vessel as was stored in step 110. In step 170, a first threshold $(dP_{int}/dt)_{min}$ is defined in relation to the expected rate of change in pressure $(dP_{int}/dt)_{exp}$ which is compared with the actual rate of change in pressure $dP_{int}/dt$ and in step 180, an alarm signal s if generated if the actual rate of change in pressure $dP_{int}/dt$ is found to be less than the first threshold $(dP_{int}/dt)_{min}$.

Figure 6:
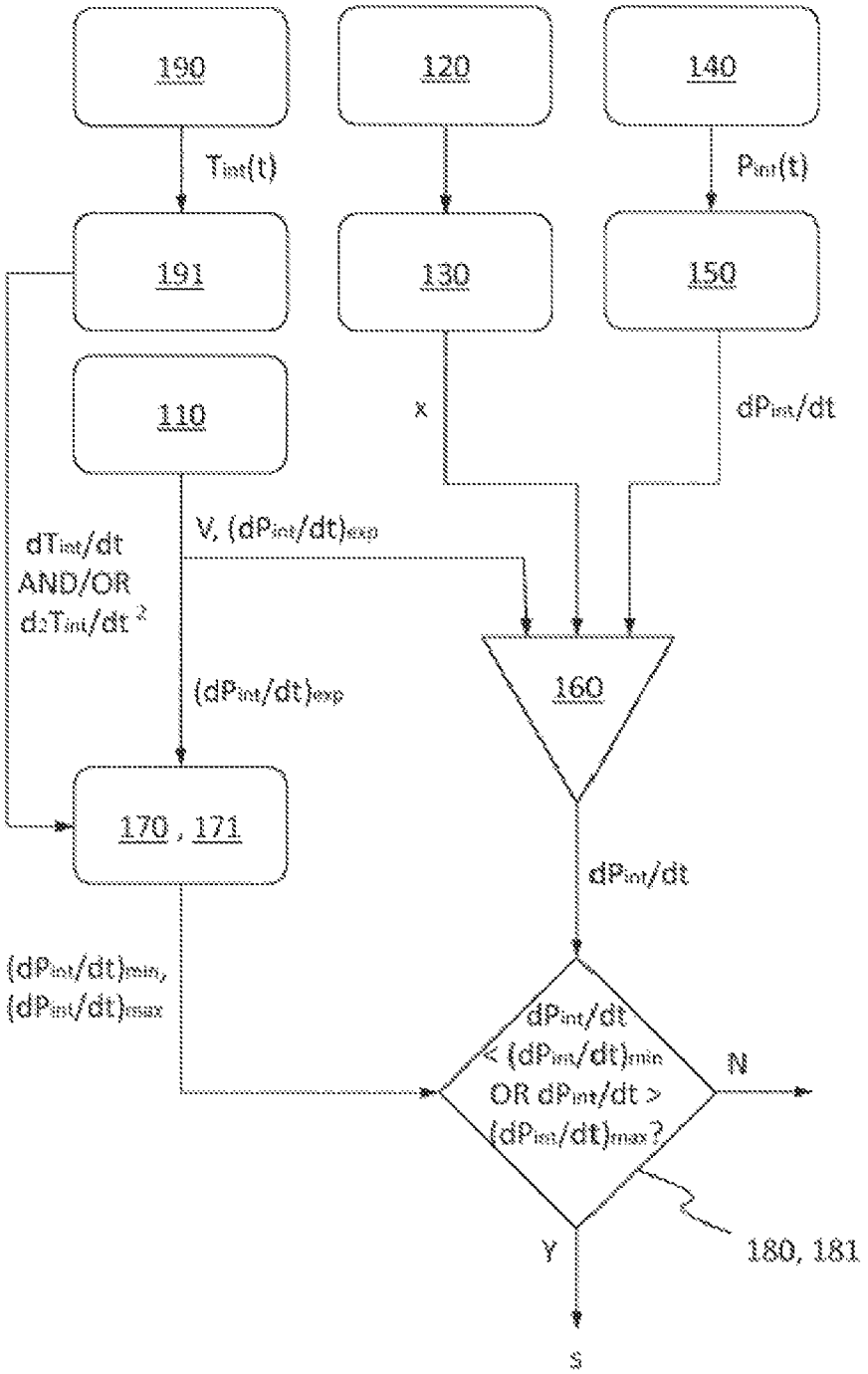
FIG. 6 is a flow diagram of a second embodiment of a method according to the invention of monitoring flow of a gas from an outlet of a vessel storing gas under pressure.

Finally, FIG. 6 is a flow diagram of a second embodiment of a method of monitoring flow of a gas from an outlet of a vessel storing gas under pressure. The method of FIG. 6 comprises steps 110 to 180 as described in relation to FIG. 5 above. Additionally, however, the method of FIG. 6 further comprises a step 171, in which a second threshold $(dP_{int}/dt)_{max}$ is defined in relation to the expected rate of change in pressure $(dP_{int}/dt)_{exp}$ which is compared with the actual rate of change in pressure $dP_{int}/dt$, and a step 181, in which the alarm signal s is also generated if the actual rate of change in pressure $dP_{int}/dt$ is more than the second threshold $(dP_{int}/dt)_{max}$. Furthermore, the method of FIG. 6 includes additional steps 190, in which a temperature $T_{int}(t)$ of the gas in the vessel is measured at different times, and 191, in which at least one of a rate of change in temperature $dT_{int}/dt$ of the gas in the vessel over time and the second derivative $d_2T_{int}/dt^2$ with respect to time of the temperature of the gas in the vessel are calculated from the temperature of the gas $T_{int}(t)$ in the vessel sensed at different times in step 190. At least one of the rate of change in temperature $dT_{int}/dt$ of the gas in the vessel over time and the second derivative $d_2T_{int}/dt^2$ with respect to time of the temperature of the gas in the vessel are then used to adjust the values of the first and second thresholds $(dP_{int}/dt)_{min}$ and $dP_{int}/dt)_{max}$ defined in steps 170 and 171. Steps 190 and 191 are representative of alternative possible embodiments in which the external temperature or pressure of an environment of the vessel may alternatively or additionally be used to adjust at least one of the values of the first and second thresholds $(dP_{int}/dt)_{min}$ and $dP_{int}/dt)_{max}$ defined in steps 170 and 171.

Whereas various optional features of the invention have been described above in particular combinations by way of example only, such optional features may be combined in other ways without restriction to the scope of the invention, which is defined by the appended claims.

The invention claimed is:

1. A monitoring apparatus (1, 2) for an outlet (10*a*) of a vessel (10) storing oxygen gas under pressure and for supplying oxygen gas to a patient, comprising:

a flow control valve (21) movable to a position between a fully open position and a fully closed position to adjust a flow of oxygen gas from the outlet (10*a*) of the vessel (10) to the patient;

a valve position detector (22) connected to the flow control valve (21) to detect the position of the flow control valve (21);

an internal pressure sensor (14) to sense an internal pressure (Pint(t)) of the oxygen gas in the vessel (10) at different times;

a processor (16) connected to the internal pressure sensor (14) to receive from the internal pressure sensor (14) the pressure (Pint(t)) sensed thereby at different times and to calculate an actual rate of change in pressure (dPint/dt) of the oxygen gas in the vessel (10) over time from the pressure (Pint(t)) of the oxygen gas in the vessel (10) sensed at different times;

a memory (11) to store a volume of the vessel (10) and for that volume, an expected rate of change in pressure ((dPint/dt)exp) of the oxygen gas in the vessel (10) for each of a plurality of different positions of the flow control valve (21);

the processor (16) being connected to the valve position detector (22) to receive from the valve position detector (22) the position of the valve (21) detected thereby, to retrieve from the memory (11) the volume of the vessel (10) and for that volume, the expected rate of change in pressure ((dPint/dt)exp) of the oxygen gas in the vessel (10) for the position of the valve (21) detected by the valve position detector (22), and to compare the actual rate of change in pressure (dPint/dt) with the expected rate of change in pressure ((dPint/dt)exp) for the same position of the valve (21) as detected by the valve position detector (22) and the same volume of the vessel (10) as retrieved from the memory (11); and an alarm (18) connected to the processor (16) to receive from the processor (16) an alarm signal (s) to activate the alarm (18) if the actual rate of change in pressure (dPint/dt) is less than a first threshold ((dP/dt)min) defined in relation to the expected rate of change in pressure ((dPint/dt)exp) which is compared with the actual rate of change in pressure (dPint/dt) and/or is more than a second threshold ((dP/dt)max) defined in relation to the expected rate of change in pressure ((dPint/dt)exp) which is compared with the actual rate of change in pressure (dPint/dt).

2. The monitoring apparatus (1, 2) according to claim 1, wherein the expected rate of change in pressure ((dPint/dt)exp) of the oxygen gas in the vessel (10) stored in the memory (11) for each of a plurality of different positions of the flow control valve (21) and for the volume of the vessel (10) is one of a plurality of expected rates of change in pressure ((dPint/dt)exp) stored in the memory (11) for vessels of different volumes, of the oxygen gas in each respective vessel for each of a plurality of different positions of the flow control valve (21).

3. The monitoring apparatus (1, 2) according to claim 1, further comprising a first user interface (23) whereby a user may manually define at least one of the first and second thresholds ((dPint/dt)min, (dPint/dt)max).

4. The monitoring apparatus (1, 2) according to claim 1, wherein the processor (16) is able to calculate at least one of the first and second thresholds ((dPint/dt)min, (dPint/dt)max) in dependence on the expected rate of change in pressure ((dPint/dt)exp) which is compared with the actual rate of change in pressure (dPint/dt).

5. The monitoring apparatus (1, 2) according to claim 4, wherein the processor (16) calculates a range ((dPint/dt)max-(dPint/dt)min) of acceptable rates of change in pressure between the first and second thresholds ((dPint/dt)min, (dPint/dt)max) in proportion to the expected rate of change in pressure ((dPint/dt)exp) which is compared with the actual rate of change in pressure (dPint/dt).

6. The monitoring apparatus (1, 2) according to claim 1, wherein the processor (16) gives the alarm signal (s) a first characteristic if the actual rate of change in pressure (dPint/dt) is less than the first threshold (dPint/dt)min and a second characteristic different from the first characteristic if the actual rate of change in pressure (dPint/dt) is more than the second threshold (dPint/dt)max.

7. The monitoring apparatus (1, 2) according to claim 1, further comprising a second user interface (24) whereby a user may manually disable the alarm (18).

8. The monitoring apparatus (1, 2) according to claim 1, further comprising an internal temperature sensor (13) to sense a temperature (Tint(t)) of the oxygen gas in the vessel (10) at different times, the processor (16) being connected to the internal temperature sensor (13) to receive from the internal temperature sensor (13) the temperature (Tint(t)) sensed thereby at different times and to calculate at least one of a rate of change in temperature (dTint/dt) of the oxygen gas in the vessel (10) over time and the second derivative (d2Tint/dt2) with respect to time of the temperature of the oxygen gas in the vessel (10) from the temperature (Tint(t)) of the oxygen gas in the vessel (10) sensed at different times, and either to adjust a value of at least one of the first and second thresholds ((dPint/dt)min, (dPint/dt)max) or to disable the alarm (18) on the basis of the rate of change in temperature (dTint/dt) of the oxygen gas in the vessel (10) over time or of the second derivative (d2Tint/dt2) with respect to time of the temperature of the oxygen gas in the vessel (10).

9. The monitoring apparatus (1, 2) according to claim 1, further comprising an external temperature sensor (15) to measure a temperature (Text) of an external environment (20) of the vessel (10), the processor (16) being connected to the external temperature sensor (15) to receive from the external temperature sensor (15) the temperature (Text) of the environment (20) measured thereby and either to adjust a value of at least one of the first and second thresholds ((dPint/dt)min, (dPint/dt)max) or to disable the alarm (18)

on the basis of the measured temperature (Text) of the environment (20) or the first derivative (dText/dt) or second derivative (d2Text/dt2) with respect to time of the measured temperature (Text) of the environment (20).

10. The monitoring apparatus (1, 2) according to claim 1, further comprising an external pressure sensor (17) to sense a pressure (Pext) of the external environment (20) of the vessel (10), the processor (16) being connected to the external pressure sensor (17) to receive from the external pressure sensor (17) the pressure (Pext) of the environment (20) sensed thereby and either to adjust a value of at least one of the first and second thresholds ((dPint/dt)min, (dPint/dt)max) or to disable the alarm (18) on the basis of the sensed pressure (Pext) of the environment (20) or the first derivative (dPext/dt) or second derivative (d2Pext/dt2) with respect to time of the sensed pressure (Pext) of the environment (20).

11. The monitoring apparatus (1, 2) according to claim 1, wherein the processor (16) is arranged to poll the internal pressure sensor (14) at a given frequency.

12. The monitoring apparatus (1, 2) according to claim 1, wherein the processor (16) is arranged to log in the memory (11) the internal pressure (Pint(t)) of the oxygen gas in the vessel (10) sensed at different times.

13. The monitoring apparatus (1, 2) according to claim 12, wherein the processor (16) is arranged to log in the memory (11) at least one of the detected position of the flow control valve (21), the temperature (Tint(t)) of the oxygen gas in the vessel (10) measured at different times, the measured temperature (Text) of the external environment (20) of the vessel (10) and the sensed pressure (Pext) of the external environment (20) of the vessel (10).

14. The monitoring apparatus (1, 2) according to claim 1, further comprising a display (19) connected to the processor (16) for visually displaying an alarm condition if the actual rate of change in pressure (dPint/dt) is less than the first threshold (dPint/dt)min and/or more than the second threshold (dPint/dt)max.

15. The monitoring apparatus (1, 2) according to claim 1, further comprising:

a first user interface (23) whereby a user may manually define at least one of the first and second thresholds ((dPint/dt)min, (dPint/dt)max), a second user interface (24) whereby a user may manually disable the alarm (18), an internal temperature sensor (13) to sense a temperature (Tint(t)) of the oxygen gas in the vessel (10), an external temperature sensor (15) to measure a temperature (Text) of an external environment (20) of the vessel (10), an external pressure sensor (17) to sense a pressure (Pext) of the external environment (20) of the vessel (10), and a display (19) connected to the processor (16) for visually displaying an alarm condition if the actual rate of change in pressure (dPint/dt) is less than the first threshold (dPint/dt)min and/or more than the second threshold (dPint/dt)max, wherein the flow control valve (21), the valve position detector (22), the internal pressure sensor (14), the processor (16), the memory (11), the alarm (18), the first user interface (23), the second user interface (24), the internal temperature sensor (13), the external temperature sensor (15), the external pressure sensor (17) and the display (19) are integrated into a unit (30) mountable to the outlet (10*a*) of the vessel (10).

16. A vessel (10) storing oxygen gas under pressure with an outlet (10*a*) having a monitoring apparatus (1, 2) according to claim 1 mounted thereto.

17. A method of monitoring flow of oxygen gas from an outlet (10*a*) of a vessel (10) storing oxygen gas under pressure to a patient, comprising:

controlling (120) the flow of oxygen gas from the outlet (10*a*) of the vessel (10) to the patient with a flow control valve (21) movable to a position (x) between a fully open position and a fully closed position;

detecting (130) the position (x) of the flow control valve (21);

sensing (140) an internal pressure (Pint(t)) of the oxygen gas in the vessel (10) at different times;

calculating (150) an actual rate of change in pressure (dPint/dt) of the oxygen gas in the vessel (10) over time from the pressure of the oxygen gas (Pint(t)) in the vessel (10) sensed at different times;

storing (110) a volume (V) of the vessel (10) and for that volume, an expected rate of change in pressure ((dPint/dt)exp) of the oxygen gas in the vessel (10) for each of a plurality of different positions of the flow control valve (21);

comparing (160) the actual rate of change in pressure (dPint/dt) with the expected rate of change in pressure ((dPint/dt)exp) for the same position (x) of the valve (21) as detected and the same volume (V) of the vessel (10) as stored;

defining (170) a first threshold (dPint/dt)min in relation to the expected rate of change in pressure ((dPint/dt)exp) which is compared with the actual rate of change in pressure (dPint/dt); and generating (180) an alarm signal (s) if the actual rate of change in pressure (dPint/dt) is less than the first threshold (dPint/dt)min.

18. The method of monitoring flow of oxygen gas according to claim 17, further comprising:

defining (171) a second threshold (dPint/dt)max in relation to the expected rate of change in pressure ((dPint/dt)exp) which is compared with the actual rate of change in pressure (dPint/dt); and generating (181) the alarm signal (s) if the actual rate of change in pressure (dPint/dt) is more than the second threshold (dPint/dt)max.

19. The method of monitoring flow of oxygen gas according to claim 17, comprising manually defining at least one of the first and second thresholds ((dPint/dt)min, (dPint/dt)max).

20. The A method of monitoring flow of oxygen gas according to claim 17, comprising calculating at least one of the first and second thresholds ((dPint/dt)min, (dPint/dt)max) in dependence on the expected rate of change in pressure ((dPint/dt)exp) which is compared with the actual rate of change in pressure (dPint/dt).

21. The method of monitoring flow of oxygen gas according to claim 20, comprising calculating a range ((dPint/dt)max-(dPint/dt)min) between the first and second thresholds ((dPint/dt)min, (dPint/dt)max) in proportion to the expected rate of change in pressure ((dPint/dt)exp) which is compared with the actual rate of change in pressure (dPint/dt).

22. The method of monitoring flow of oxygen gas according to claim 17, further comprising giving the alarm signal (s) a first characteristic if the actual rate of change in pressure (dPint/dt) is less than the first threshold (dPint/dt)min and a second characteristic different from the first characteristic if the actual rate of change in pressure (dPint/dt) is more than the second threshold (dPint/dt)max.

23. The method of monitoring flow of oxygen gas according to claim 17, further comprising manually disabling the alarm signal (s).

24. The method of monitoring flow of oxygen gas according to claim 17, further comprising:

measuring (190) a temperature (Tint(t)) of the oxygen gas in the vessel (10) at different times;

calculating (191) at least one of a rate of change in temperature (dTint/dt) of the oxygen gas in the vessel (10) over time and the second derivative (d2Tint/dt2) with respect to time of the temperature of the oxygen gas in the vessel (10) from the temperature of the oxygen gas (Tint(t)) in the vessel (10) sensed at different times; and either adjusting a value of at least one of the first and second thresholds ((dPint/dt)min, (dPint/dt)max) or suppressing the alarm signal (s) on the basis of at least one of the rate of change in temperature (dTint/dt) of the oxygen gas in the vessel (10) over time and the second derivative (d2Tint/dt2) with respect to time of the temperature of the oxygen gas in the vessel (10).

25. The method of monitoring flow of oxygen gas according to claim 17, further comprising:

measuring a temperature (Text) of an external environment (20) of the vessel (10); and either adjusting a value of at least one of the first and second thresholds ((dPint/dt)min, (dPint/dt)max) or suppressing the alarm signal (s) on the basis of the measured temperature (Text) of the environment (20) or the first derivative (dText/dt) or second derivative (d2Text/dt2) with respect to time of the measured temperature (Text) of the environment (20).

26. The method of monitoring flow of oxygen gas according to claim 17, further comprising:

sensing a pressure (Pext) of the external environment (20) of the vessel (10); and either adjusting a value of at least one of the first and second thresholds ((dPint/dt)min, (dPint/dt)max) or suppressing the alarm signal (s) on the basis of the sensed pressure (Pext) of the environment (20) or the first derivative (dPext/dt) or second derivative (d2Pext/dt2) with respect to time of the sensed pressure (Pext) of the environment (20).

27. The method of monitoring flow of oxygen gas according to claim 17, wherein the step of sensing the internal pressure (Pint(t)) of the oxygen gas in the vessel (10) at different times is carried out at a given frequency.

28. The method of monitoring flow of oxygen gas according to claim 27, wherein at least one of the steps of detecting the position (x) of the flow control valve (21), measuring the temperature (Tint(t)) of the oxygen gas in the vessel (10) at different times, measuring the temperature (Text) of the external environment (20) of the vessel (10) and sensing the pressure (Pext) of the external environment (20) of the vessel (10) are carried out at the given frequency.

29. The method of monitoring flow of oxygen gas according to claim 27, wherein the given frequency is between 2 and 0.05 times per second.

30. The method of monitoring flow of oxygen gas according to claim 17, further comprising logging the internal pressure (Pint(t)) of the oxygen gas in the vessel (10) sensed at different times.

31. The method of monitoring flow of oxygen gas according to claim 30, further comprising logging at least one of the detected position (x) of the flow control valve (21), the temperature (Tint(t)) of the oxygen gas in the vessel (10) measured at different times, the measured temperature (Text) of the external environment (20) of the vessel (10) and the sensed pressure (Pext) of the external environment (20) of the vessel (10).

32. The method of monitoring flow of oxygen gas according to claim 30, wherein the step of calculating the actual rate of change in pressure (dPint/dt) of the oxygen gas in the vessel (10) over time is carried out using a moving average over a given period of time of the logged internal pressure (Pint(t)) of the oxygen gas in the vessel (10) sensed at different times.

33. The method of monitoring flow of oxygen gas according to claim 32, further comprising:

measuring (190) a temperature (Tint(t)) of the oxygen gas in the vessel (10) at different times;

logging the temperature (Tint(t)) of the oxygen gas in the vessel (10) measured at different times, calculating (191) at least one of a rate of change in temperature (dTint/dt) of the gas in the vessel (10) over time and the second derivative (d2Tint/dt2) with respect to time of the temperature of the gas in the vessel (10) from the temperature of the oxygen gas (Tint(t)) in the vessel (10) sensed at different times; and wherein the step of calculating at least one of a rate of change in temperature (dTint/dt) of the oxygen gas in the vessel (10) over time is carried out using a moving average over the same given period of time of the logged temperature (Tint(t)) of the oxygen gas in the vessel (10) measured at different times.

34. The method of monitoring flow of oxygen gas according to claim 32, wherein the given period of time is defined in relation to the expected rate of change in pressure ((dPint/dt)exp) which is compared with the actual rate of change in pressure (dPint/dt).

35. The method of monitoring flow of oxygen gas according to claim 34, wherein the given period of time is between 20 seconds and 10 minutes if the flow control valve (21) is detected to be in an open position and between 10 minutes and 4 hours if the flow control valve (21) is detected to be in the fully closed position.

36. The method of monitoring flow of oxygen gas according to claim 17, further comprising visually displaying an alarm condition if the actual rate of change in pressure (dPint/dt) is less than the first threshold (dPint/dt)min) and/or more than the second threshold ((dPint/dt)max).

37. The method of monitoring flow of oxygen gas according to claim 17, wherein the steps of controlling the flow of oxygen gas from the outlet (10*a*) of the vessel (10), detecting the position (x) of the flow control valve (21), sensing the internal pressure (Pint(t)) of the oxygen gas in the vessel (10) at different times, calculating the actual rate of change in pressure (dPint/dt) of the oxygen gas in the vessel (10) over time, storing the volume (V) of the vessel (10) and for that volume, an expected rate of change in pressure ((dPint/dt)exp), comparing the actual rate of change in pressure (dPint/dt) with the expected rate of change in pressure ((dPint/dt)exp), measuring the temperature (Tint(t)) of the oxygen gas in the vessel (10) at different times, measuring the temperature (Text) of the external environment (20) of the vessel (10), sensing the pressure (Pext) of the external environment (20) of the vessel (10), defining at least one of the first and second thresholds ((dPint/dt)min, (dPint/dt)max), generating (180) an alarm signal (s) and visually displaying the alarm condition are performed in a unit (30) mounted to the outlet (10*a*) of the vessel (10).

38. The monitoring apparatus (1, 2) according to claim 37, further comprising an external temperature sensor (15) to measure a temperature (Text) of an external environment (20) of the vessel (10), the processor (16) being connected to the external temperature sensor (15) to receive from the external temperature sensor (15) the temperature (Text) of the environment (20) measured thereby and either to adjust a value of at least one of the first and second thresholds ((dPint/dt)min, (dPint/dt)max) or to disable the alarm (18) on the basis of the measured temperature (Text) of the environment (20) or the first derivative (dText/dt) or second derivative (d2Text/dt2) with respect to time of the measured temperature (Text) of the environment (20).

39. The monitoring apparatus (1, 2) according to claim 38, further comprising an external pressure sensor (17) to sense a pressure (Pext) of the external environment (20) of the vessel (10), the processor (16) being connected to the external pressure sensor (17) to receive from the external pressure sensor (17) the pressure (Pext) of the environment (20) sensed thereby and either to adjust a value of at least one of the first and second thresholds ((dPint/dt)min, (dPint/dt)max) or to disable the alarm (18) on the basis of the sensed pressure (Pext) of the environment (20) or the first derivative (dPext/dt) or second derivative (d2Pext/dt2) with respect to time of the sensed pressure (Pext) of the environment (20).

40. The monitoring apparatus (1, 2) according to claim 39, wherein the processor (16) is arranged to poll the internal pressure sensor (14) at a given frequency.

41. The monitoring apparatus (1, 2) according to claim 40, wherein the processor (16) is arranged to poll at least one of the valve position detector (22), the internal temperature sensor (13), the external temperature sensor (15) and the external pressure sensor (17) at the same given frequency.

42. A monitoring apparatus for an outlet of a vessel storing oxygen gas under pressure and for supplying oxygen gas to a patient, comprising:

a flow control valve movable to a position between a fully open position and a fully closed position to adjust a flow of oxygen gas from the outlet of the vessel to the patient;

a valve position detector connected to the flow control valve to detect the position of the flow control valve;

an internal pressure sensor to sense an internal pressure, Pint(t), of the oxygen gas in the vessel at different times;

a processor connected to the internal pressure sensor to receive from the internal pressure sensor the pressure Pint(t) sensed thereby at different times and to calculate an actual rate of change in pressure, dPint/dt, of the oxygen gas in the vessel over time from the pressure Pint(t) of the oxygen gas in the vessel sensed at different times;

a memory to store a volume of the vessel and for that volume, an expected rate of change in pressure, (dPint/dt)exp, of the oxygen gas in the vessel for each of a plurality of different positions of the flow control valve;

the processor being connected to the valve position detector to receive from the valve position detector the position of the valve detected thereby, to retrieve from the memory the volume of the vessel and for that volume, the expected rate of change in pressure, (dPint/dt)exp, of the oxygen gas in the vessel for the position of the valve detected by the valve position detector, and to compare the actual rate of change in pressure dPint/dt with the expected rate of change in pressure dPint/dt)exp for the same position of the valve as detected by the valve position detector and the same volume of the vessel as retrieved from the memory; and an alarm connected to the processor to receive from the processor:

(a) a first alarm signal to activate the alarm if the actual rate of change in pressure dPint/dt is less than a first threshold, (dP/dt)min, defined in relation to the expected rate of change in pressure (dPint/dt)exp which is compared with the actual rate of change in pressure dPint/dt, and (b) a second alarm signal to activate the alarm if the actual rate of change in pressure dPint/dt is more than a second threshold, (dP/dt)max, defined in relation to the expected rate of change in pressure (dPint/dt)exp which is compared with the actual rate of change in pressure dPint/dt.

43. The monitoring apparatus according to claim 42, wherein the first alarm signal has a first characteristic and the second alarm signal has a second characteristic different from the first characteristic.

* * * * *